US008814226B2

(12) United States Patent
Akizuki et al.

(10) Patent No.: US 8,814,226 B2
(45) Date of Patent: Aug. 26, 2014

(54) DOOR LOCK DEVICE FOR VEHICLE

(75) Inventors: Ryujiro Akizuki, Novi, MI (US); Takashi Nishio, Kariya (JP); Nobuko Watanabe, Anjo (JP); Kazunori Kojima, Aichi-gun (JP); Sho Sannohe, Chiryu (JP); Yusuke Yamada, Chiryu (JP); Yasuhiko Sono, Hekinan (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 250 days.

(21) Appl. No.: 13/387,468

(22) PCT Filed: Jun. 30, 2010

(86) PCT No.: PCT/JP2010/061496
§ 371 (c)(1),
(2), (4) Date: Jan. 27, 2012

(87) PCT Pub. No.: WO2011/013487
PCT Pub. Date: Feb. 3, 2011

(65) Prior Publication Data

US 2012/0119520 A1 May 17, 2012

(30) Foreign Application Priority Data

Jul. 27, 2009 (JP) ..... 2009-17448

(51) Int. Cl.
*E05C 3/06* (2006.01)

(52) U.S. Cl.
USPC ..... 292/196; 292/216; 292/201; 292/DIG. 23

(58) Field of Classification Search
USPC ..... 292/196, 201, 216, DIG. 23
See application file for complete search history.

(56) References Cited

U.S. PATENT DOCUMENTS

| | | | | |
|---|---|---|---|---|
| 7,055,872 | B2 | 6/2006 | Hayakawa et al. | |
| 7,559,586 | B2 | 7/2009 | Fukunaga et al. | |
| 2004/0119296 | A1 | 6/2004 | Hayakawa et al. | |
| 2006/0186676 | A1 * | 8/2006 | Fukunaga et al. | 292/216 |
| 2008/0048458 | A1 * | 2/2008 | Suzumura et al. | 292/216 |
| 2011/0260476 | A1 | 10/2011 | Akizuki et al. | |

FOREIGN PATENT DOCUMENTS

| | | | |
|---|---|---|---|
| CN | 1824915 | A | 8/2006 |
| DE | 103 34 607 | A1 | 4/2004 |
| DE | 60 2006 000 788 | T2 | 4/2009 |
| EP | 1 726 754 | A1 | 11/2006 |
| JP | 2004-124687 | A | 4/2004 |
| JP | 2006-233507 | A | 9/2006 |
| JP | 2009-046815 | A | 3/2009 |

OTHER PUBLICATIONS

International Search Report (PCT/ISA/210) issued on Sep. 21, 2010, by Japanese Patent Office as the International Searching Authority for International Application No. PCT/JP2010/061496.

* cited by examiner

*Primary Examiner* — Kristina Fulton
*Assistant Examiner* — Christine M Mills
(74) *Attorney, Agent, or Firm* — Buchanan Ingersoll & Rooney

(57) ABSTRACT

A door lock device for a vehicle, provided with an opening lever driven as a door handle is operated, an opening link interposed between the opening lever and a lift lever of a latch mechanism, a lock operation unit for switching the opening link to an unlock position or a lock position, and a locking lever for driving the lock operation unit. A retaining portion is provided to the opening lever. The retaining portion holds the opening link at a retaining position between the lock position and the unlock position when the opening link becomes switched by the locking lever through the lock operation unit from the lock position to the unlock position with the opening link driven by the opening lever.

3 Claims, 11 Drawing Sheets

DOOR LOCK DEVICE FOR VEHICLE

TECHNICAL FIELD

The present invention relates to a door lock device for vehicle.

RELATED ART

One example of door lock device for a vehicle includes a latch mechanism adapted to be capable of retaining a vehicle door in a closed state relative to a vehicle body, an open lever adapted to be driven along with operation to a door handle provided any of the inside and the outside of the door, an open link interposed between the open lever and a lift lever, the open link provided in the latch mechanism, and capable of switching between an unlock position in which actuation of the open lever in a door-open direction along with door-open operation to the door handle is transmitted to the lift lever, and a lock position in which actuation of the open lever in a door-open direction along with door-open operation to the door handle is not transmitted to the lift lever, and a lock operation unit that switches the open link between the unlock position and the lock position. The lock operation unit includes an active lever that is driven rotationally, a drive mechanism that drives the active lever, and a sub lever assembled to the active lever in a relatively rotatable manner and linked with the open link to be rotatably actuated. The sub lever is set so as to move integrally with the active lever when the open link is switched from the unlock position to the lock position, and to move with the active lever through a bias member when the open link is switched from the lock position to the unlock position, as disclosed in JP2006-233507A.

In the door lock device for the vehicle disclosed in JP2006-233507A mentioned above, in the case where the door handle is an inside door handle provided on the inside of the door and the open lever is an inside open lever driven along with operation to the inside door handle, so-called one-motion function or double-pull function can be realized by configuring the door lock device in a manner that the open link is driven by the inside open lever and the lock operation unit is driven from the lock position to the unlock position by the inside open lever when the open link is in the lock position and the inside open lever is actuated toward the door-open direction along with door-open operation to the inside door handle, and by properly setting a drive initiation timing to the open link by the inside open lever and a drive initiation timing to the lock operation unit by the inside open lever. It should be noted that the one-motion function or the double-pull function can similarly be realized in a configuration in which the open link is directly moved by the inside open lever from the lock position to the unlock position without interposing the lock operation unit, or in a configuration in which the open link is moved by the inside open lever from the lock position to the unlock position through the other member instead of interposing the lock operation unit.

The above-mentioned one-motion function can be realized by setting the drive initiation timing to the lock operation unit by the inside open lever earlier than the drive initiation timing to the open link by the inside open lever by a predetermined amount (specifically, by setting the timing for moving the open link from the lock position to the unlock position earlier). In this case, it is possible to move the open link in the lock position to the unlock position by driving the lock operation unit driven by the inside open lever before the open link is driven by the inside open lever.

Accordingly, the open link has been in the unlock position when the open link is driven by the inside open lever, and actuation of the inside open lever toward the door-open direction is transmitted to the lift lever through the open link, so that a state of the latch mechanism is switched from a latch state (state where the door cannot be opened) to an unlatch state (state where the door can be opened). Therefore, in this case, even when the door lock device is in the lock state (state where the open link is in the lock position), the door can be opened by one time of door-open operation (one time of pull operation).

Meanwhile, the above-mentioned double-pull function can be realized by setting the drive initiation timing to the lock operation unit by the inside open lever later than the drive initiation timing to the open link by the inside open lever by a predetermined amount (specifically, by setting the timing for moving the open link from the lock position to the unlock position later). In this case, the open link in the lock position moves toward the unlock position after the open link is driven by the inside open lever by a predetermined amount, so that the open link engages with (interferers with) the lift lever under the state where the open lever is not capable of transmitting the actuation of the inside open lever toward the door-open direction to the lift lever. It should be noted that this state is so-called panic state (state where switching of the latch mechanism from the latch state to the unlatch state is not permitted). In the panic state, a relative rotation between the active lever and the sub lever is allowed due to elastic deformation of the bias member of the lock operation unit, so that the active lever is capable of rotating to the unlock position.

Thus, in this case, the above-mentioned panic state can be cancelled by returning the inside door handle once experienced door-open operation and performing the door-open operation again (by performing pull operation twice) and thus the door can be opened. It should be noted that, when the inside door handle once experienced the door-open operation is returned, engagement (interference) between the open link and the lift lever and engagement (abutment) between the inside open lever and the open link are cancelled due to the inside lever and the open link moving toward a default position along with the returning operation to the inside door handle.

Thus, the sub lever of the lock operation unit is rotated by the bias member to the unlock position, so that the open link is moved to the unlock position. Accordingly, at the time of the second door-open operation to the inside door handle, the open link has been in the unlock position when the open link is driven by the inside open lever, and thus operation to the inside open lever toward the door-open direction is transmitted to the lift lever through the open link, so that the latch mechanism is switched from the latch state to the unlatch state where the door can be opened.

SUMMARY OF THE INVENTION

In the door lock device disclosed in the above-mentioned JP2006-233507A, the double-pull function can be realized as mentioned above. However, in the case where the double-pull function is realized, one time of door-open operation to the inside door handle leads to the panic state, in which the open link engages with (interfere with) the lift lever in a state where the open link is incapable of transmitting the door-open operation to the inside open lever to the lift lever. Accordingly, the engagement between the open link and the lift lever may bring a discomfort feeling upon handle operation.

The present invention is derived to solve the above-mentioned problem (to improve the feeling upon handle operation in the panic state). According to the present invention, in the above-mentioned door lock device to which the present invention is objected, a retaining portion is provided on the open lever that retains the open link at a retaining position between the lock position and the unlock position when the open link is switched from the lock position to the unlock position in a state where the open link is in the lock position and the open lever is actuated toward the door-open direction along with the door-open operation to the door handle to drive the open link by the open lever.

According to the door lock device for the vehicle of the present invention, by means of a retaining portion that is provided on the open lever, it is possible to retain the open link at a retaining position located between the lock position and the unlock position when the open link is switched from the lock position to the unlock position in a state where the open link is in the lock position and the open lever is actuated toward the door-open direction along with the door-open operation to the door handle so as to drive the open link by the open lever. Accordingly, setting the above-mentioned retaining position where the open link does not engage with (interfere with) the lift lever enables a configuration in which the open link does not engage with (interfere with) the lift lever in the panic state and thus improvement of the feeling upon operation to the door handle at the time when the panic state is cancelled.

Upon implementing the above-mentioned present invention, the door handle may be an inside door handle provided on the inside of the door, and the open lever may be an inside open lever driven along with operation to the inside door handle. In this case, the above-mentioned double-pull function is realized and the feeling upon operation to the inside door handle is improved in this door lock device.

DETAILED DESCRIPTION OF THE INVENTION

Figure 1:
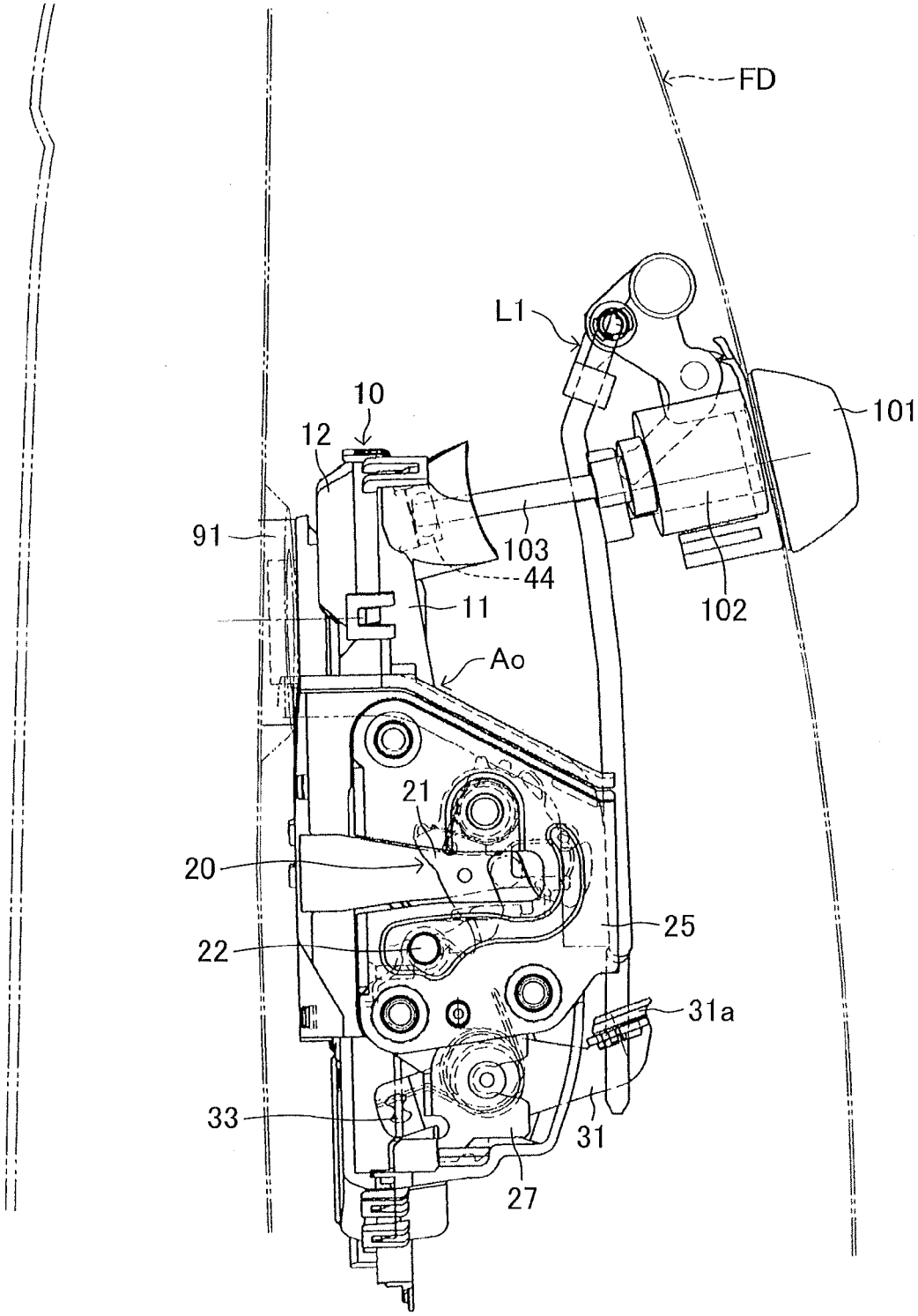
FIG. 1 is a rear view of a door lock device for a vehicle according to an embodiment of the present invention, which is arranged inside a door and observed from the rear side of the door.
Figure 2:
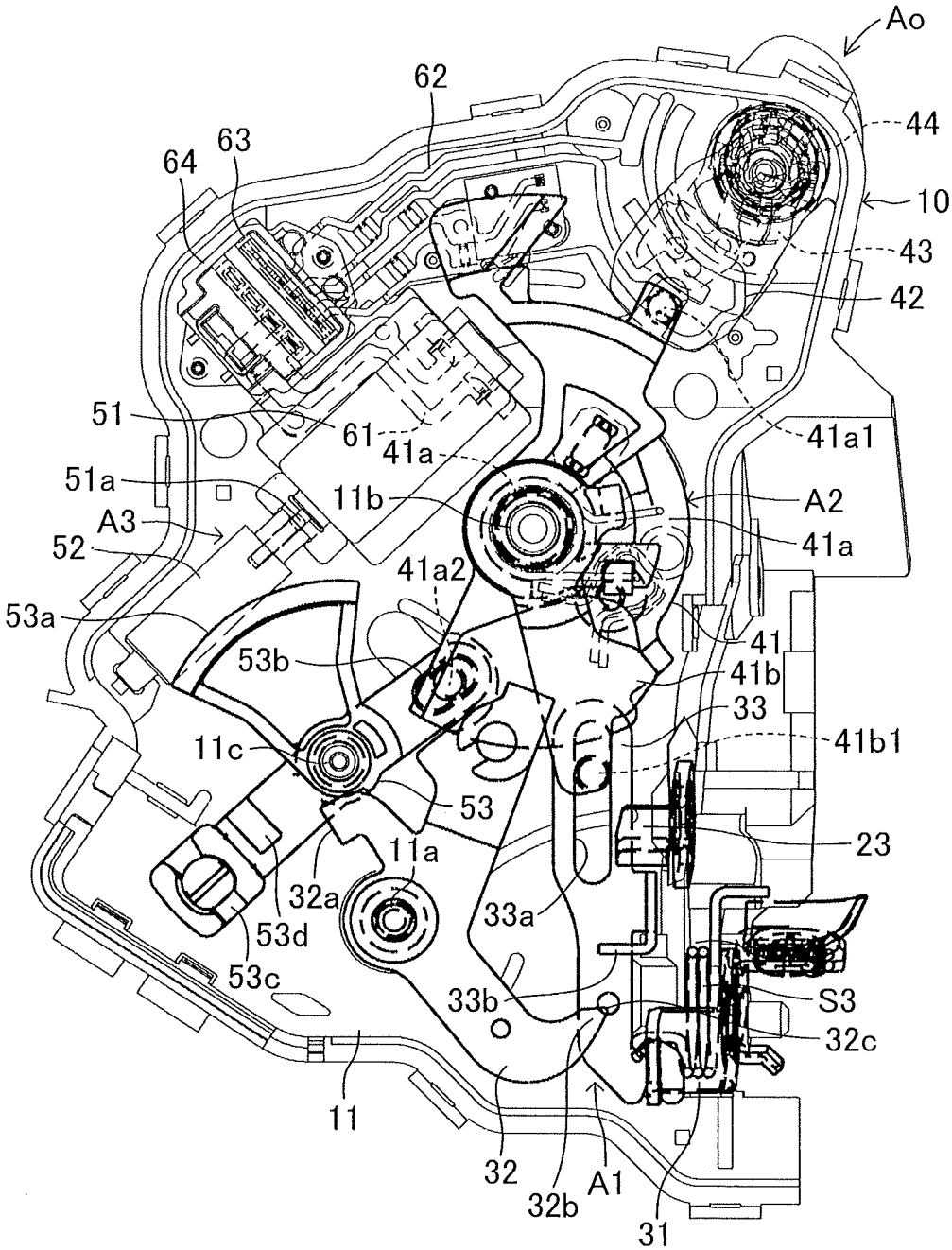
FIG. 2 is a side view of a major configuration in an unlock state of the door lock device for the vehicle shown in FIG. 1 observed from the vehicle interior.
Figure 3:
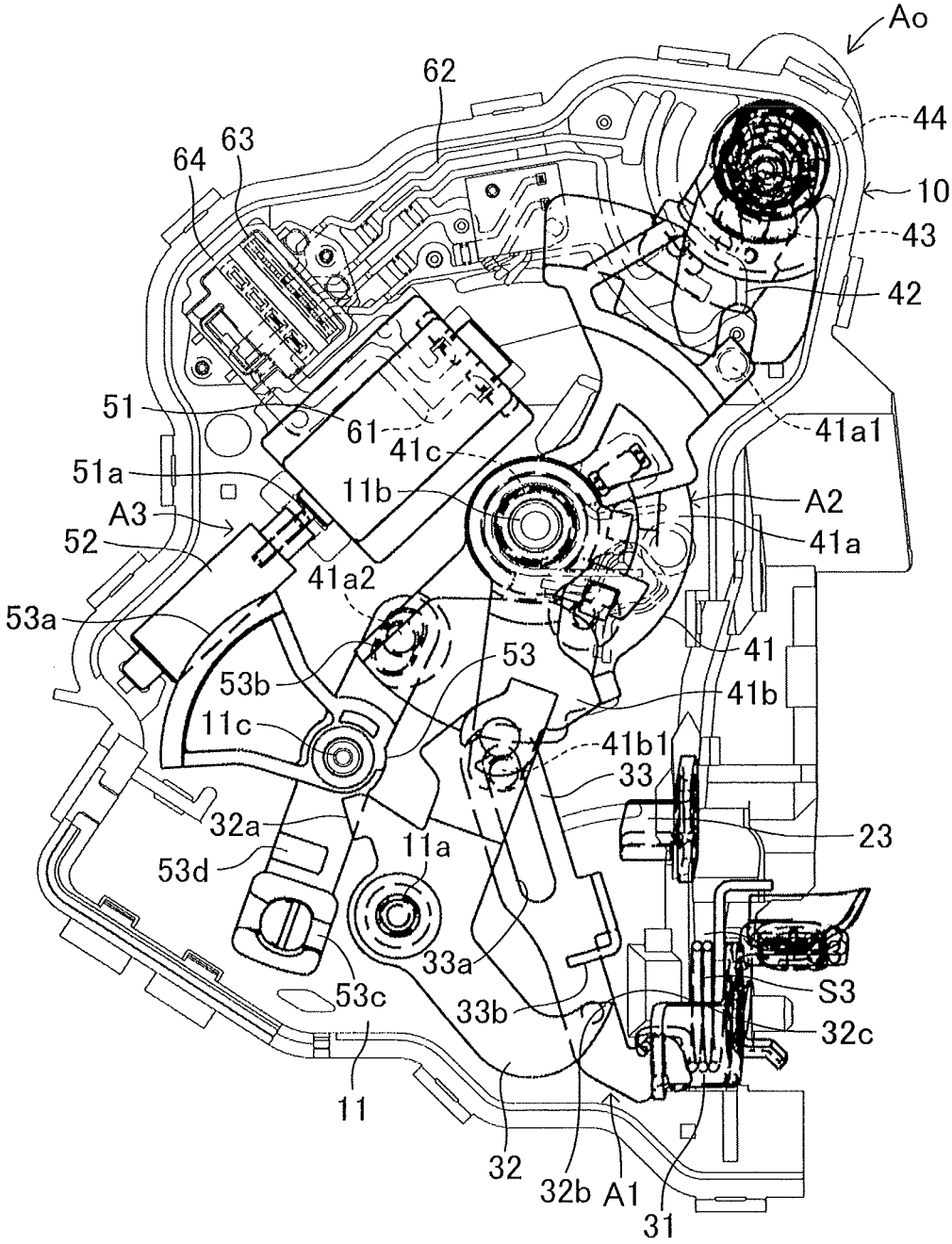
FIG. 3 is a side view of the major configuration in a lock state of the door lock device for the vehicle shown in FIG. 1 observed from the vehicle interior.
Figure 4:
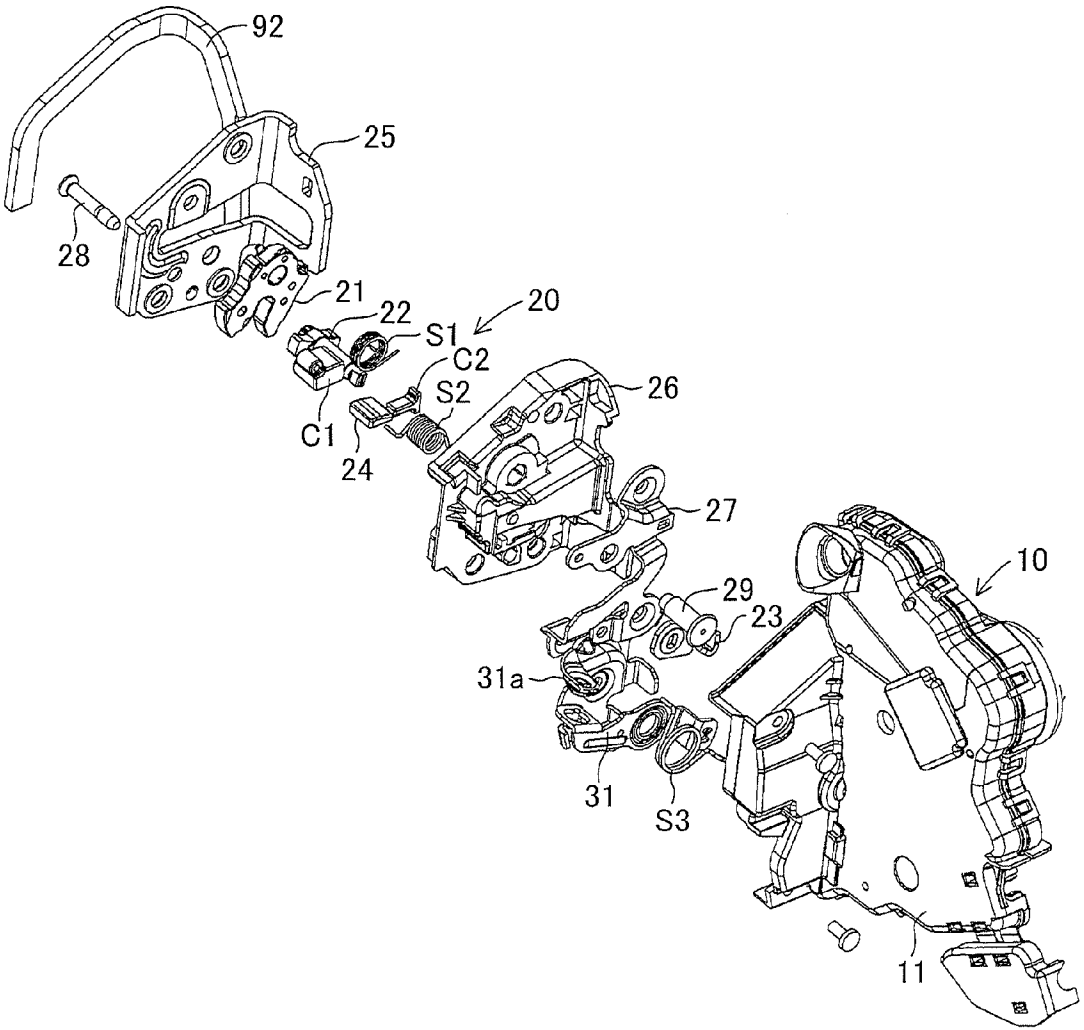
FIG. 4 is an exploded perspective view of a part of an open mechanism and a latch mechanism in the door lock device for the vehicle shown in FIGS. 1 to 3.
Figure 5:
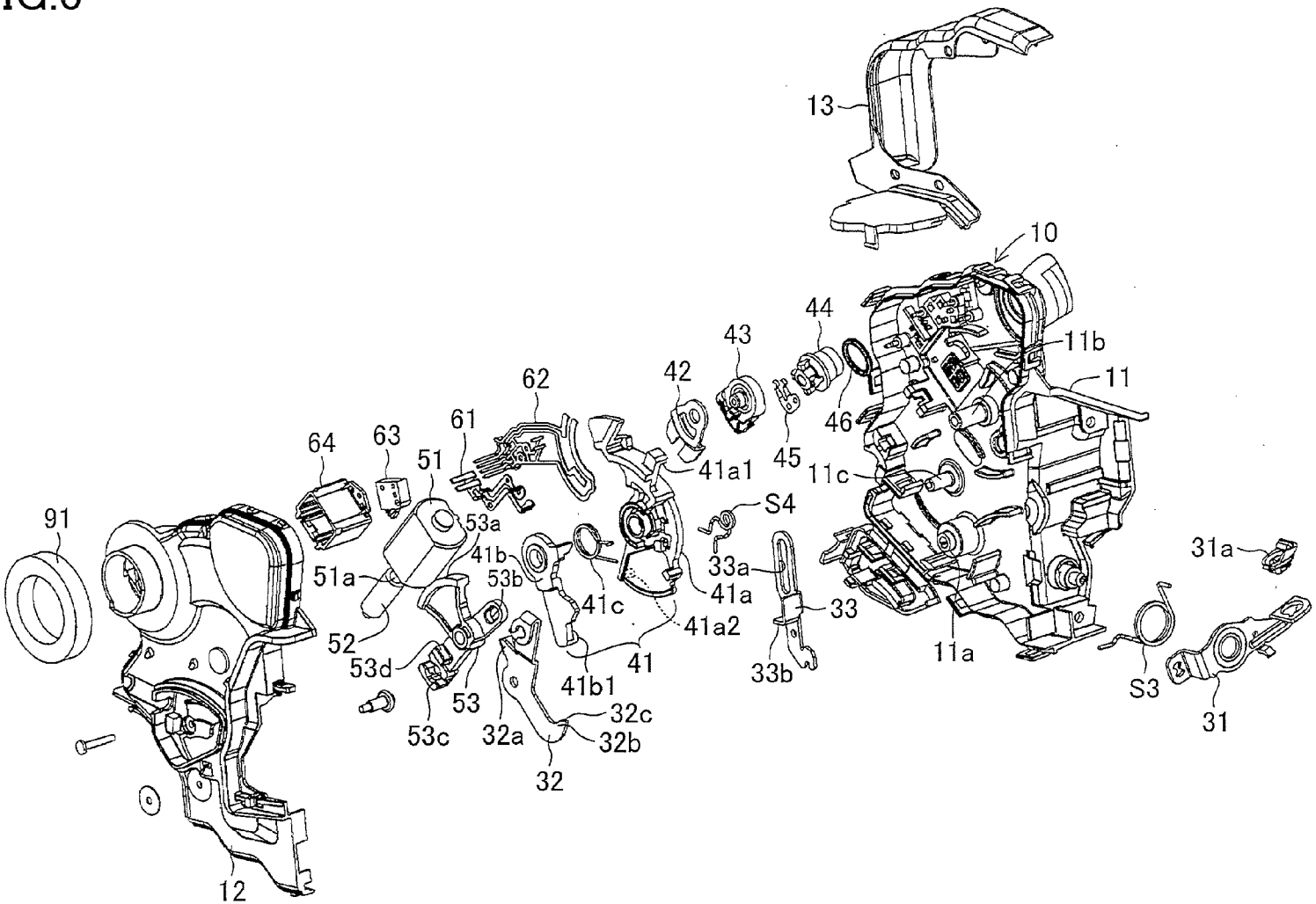
FIG. 5 is an exploded perspective view of the open mechanism, a lock mechanism, an electric actuator, and the like in the door lock device for the vehicle shown in FIGS. 1 to 3.

Hereinafter, an embodiment of the present invention will be described with reference to the drawings. FIGS. 1 to 5 show a door lock device for a vehicle Ao according to the present invention. The door lock device for the vehicle Ao is attached to a door FD mounted on the front right side of the vehicle. As shown in FIGS. 2 and 3, The door lock device Ao includes an open mechanism A1, a lock mechanism A2, an electric actuator A3, and a housing 10 accommodating the open mechanism A1, the lock mechanism A2, and the electric actuator A3. As shown in FIGS. 1, 4, and 5, the housing 10 includes a housing body 11, a housing cover 12 assembled into the housing body 11, and a protector 13 (refer to FIG. 5) assembled into the housing body 11 and the housing cover 12. It should be noted that a seal ring 91 is assembled between the housing cover 12 and an inner plate of the door FD (refer to FIG. 1).

The open mechanism A1 is provided for actuating a known latch mechanism 20 (refer to FIGS. 1 and 4) from a latch state to an unlatch state in a manner that the vehicle door FD is openable relative to a vehicle body (not shown). The latch mechanism 20 is provided for retaining the door FD in a closed state relative to the vehicle body (state where the door FD is closed), and includes a latch 21 engageable with and disengageable from a striker (not shown) fixed to the vehicle body. It should be noted that the latch mechanism 20 is not shown in FIGS. 2 and 3 other than a lift lever 23, but is shown in an exploded state in FIG. 4, where the latch mechanism 20 is assembled into the door FD in a state where the latch mechanism 20 is assembled into the housing 10 (refer to FIG. 1).

The latch mechanism 20 is engaged with the striker so as to retain the door FD in the closed state (latch state). With the door FD in the closed state, the latch mechanism 20 is disengaged from the striker, so that the door FD is switched from the closed state to an opened state (state where the door is openable relative to the vehicle body) (unlatch state). As shown in FIG. 4, the latch mechanism 20 includes the latch 21, a pawl 22, a lift lever 23, and a stopper 24. The latch mechanism 20 further includes cushions C1, C2, a latch torsion spring S1, and a pawl torsion spring S2. These constituent parts are assembled into a base plate 25, a case 26, and a sub base plate 27 by means of a screw 28 and a pin 29. It should be noted that the base plate 25 is assembled into the door FD through a seal member 92 shown in FIG. 4 (not shown in FIG. 1).

As shown in FIGS. 2 and 3, the open mechanism A1 includes an outside open lever 31, an inside open lever 32, and an open link 33. The outside open lever 31 is assembled into the housing body 11 together with a torsion spring S3 (a spring for biasing the outside open lever 31 counterclockwise in FIG. 1 toward a default position shown in FIG. 1), linked with an outside door handle 101 (refer to FIG. 1) provided on the outdoor side of the door FD through a link mechanism L1, and actuated to rotate clockwise in FIG. 1 by pull operation (door-open operation) to the outside door handle 101. It should be noted that a clip 31*a* (refer to FIGS. 1, 4, and 5) is assembled into the outside open lever 31.

The inside open lever 32 is rotatably assembled to a support shaft 11*a* provided on the housing body 11, and is linked with an inside door handle (not shown) provided on the interior of the door FD in a well-known configuration. The inside open lever 32 is actuated to rotate counterclockwise in FIGS. 2 and 3 by pull operation (door-open operation) to the inside door handle (not shown). The open link 33 is interposed between the respective open levers 31, 32 and the lift lever 23 provided in the latch mechanism 20, and is movably coupled to and supported on the outside open lever 31 at a lower end thereof. The open link 33 can be moved by a lock operation unit 41, which is a component of the lock mechanism A2, between the unlock position shown in FIG. 2 and the lock position shown in FIG. 3.

This open link 33 includes, at an upper end portion, a long hole 33*a* extending in the vertical direction in the state in FIG. 2, and a pushing portion 33*b* formed in a L-shape at an intermediate portion thereof. The pushing portion 33*b* is, in a state where the open link 33 is in the unlock position shown in FIG. 2, capable of engaging with the lift lever 23 of the latch mechanism 20 (that is, the pushing portion 33*b* is capable of transmitting the door-open-direction operation to the respective open levers 31, 32 to the lift lever 23) so as to bring the door FD into an opened state. Meanwhile, the pushing portion 33*b* is, in a state where the open link 33 is in the lock position shown in FIG. 3, incapable of engaging with the lift lever 23 of the latch mechanism 20 (that is, the pushing portion 33*b* is incapable of transmitting the door-open direction operation to the respective open levers 31, 32 to the lift lever 23).

The open link 33 is moved from the positions shown in FIGS. 2 and 3 in the upward direction of the device (toward the upper side in FIGS. 2 and 3) upon receiving operation to the outside open lever 31 in the door-open direction (pull operation to the outside door handle 101) at the pushing portion 33*b*, or receiving operation to the inside open lever 32 in the door-open direction (pull operation to the inside door handle) at the pushing portion 33*b*. Therefore, in the case where the open link 33 at the unlock position shown in FIG. 2 with the door FD in the closed state is moved in the upward direction upon receiving operation to the outside open lever 31 or to the inside open lever 32 in the door-open direction at the pushing portion 33*b*, the lift lever 23 of the latch mechanism 20 is pushed by pushing portion 33*b* of the open link 33 and rotates, so that the latch mechanism 20 is actuated from the latch state to the unlatch state. Thereby, the door FD is switched from the closed state to the opened state. That is, when the open link 33 is at the unlock position in FIG. 2, the door FD is unlocked.

Meanwhile, in the case where the open link 33 at the lock position shown in FIG. 3 with the door FD in the closed state is moved in the upward direction upon receiving the actuation of the outside open lever 31 or the inside open lever 32 in the door-open direction at the pushing portion 33*b*, the pushing portion 33*b* of the open link 33 is not engaged with the lift lever 23 of the latch mechanism 20, so that the latch mechanism 20 is maintained in the latch state. Thereby, the door FD is maintained in the closed state. That is, when the open link 33 is at the lock position in FIG. 3, the door FD is locked.

The lock mechanism A2, which is provided for restraining or permitting the actuation of the open mechanism A1 so as to lock or unlock the door FD, includes the above-mentioned lock operation unit 41. The lock mechanism A2 also includes a locking control lever 42 for driving the above open link 33 to the lock position or the unlock position through the lock operation unit 41, a key switch lever 43, an outside locking lever 44, a contact 45 assembled to the key switch lever 43, a seal ring 46 assembled between the outside locking lever 44 and the housing body 11, and the like (refer to FIGS. 2, 3, and 5). It should be noted that the locking control lever 42, the key switch lever 43 and the outside locking lever 44 are coupled to each other in a torque transmittable manner. Moreover, the outside locking lever 44 is, as shown in FIG. 1, connected to a tip portion of a rod 103 in a torque transmittable manner.

The lock operation unit 41, which is provided for switching the position of the open link 33 between the unlock position and the lock position, is assembled along with a torsion spring S4 (refer to FIG. 5) to a support shaft 11*b* provided on the housing body 11, and is rotatably supported by the support shaft 11*b*. The lock operation unit 41 includes an active lever 41*a*, a sub lever 41*b*, and a twisted spring 41*c* (bias member) as shown in FIGS. 2, 3, and 5.

The active lever 41*a* is rotatably assembled to the support shaft 11*b*, and includes an engagement portion 41*a*1 linked with a locking control lever 42 (component of a mechanical drive mechanism) and also an engagement portion (pin portion) 41*a*2 linked with the electric actuator A3 (electric drive mechanism). The sub lever 41*b* is rotatably assembled to the support shaft 11*b*. The sub lever 41*b* is rotatable relative to the active lever 41*a* by a predetermined amount, and has an engagement portion (pin portion) 41*b*1 linked with the long hole 33*a* of the open link 33.

The twisted spring 41*c* (bias member) is, as well as the twisted spring (bias member) described in JP2006-233507A, interposed between the active lever 41*a* and the sub lever 41*b*, and biases the sub lever 41*b* in one rotation direction (counterclockwise direction in FIGS. 2 and 3) relative to the active lever 41*a*. Thus, the active lever 41*a* and the sub lever 41*b* integrally rotate clockwise in the Figs (when the open link 33 is switched from the unlock position to the lock position). Meanwhile, the active lever 41*a* and the sub lever 41*b* rotate in conjunction with each other through the twisted spring 41*c* in the unlock position (when the open link 33 is switched from the lock position to the unlock position).

The locking control lever 42, which is actuated to rotate by a mechanical key operation to a key cylinder 102 (refer to FIG. 1) provided on the outdoor side of the door FD, is assembled into the housing body 11 together with the key switch lever 43, the outside locking lever 44, and the like, and linked with the engagement portion 41*a*1 of the active lever 41*a* in the lock operation unit 41. Therefore, when the locking control lever 42 is rotationally actuated through the rod 103, the outside locking lever 44, and the key switch lever 43 by the mechanical key operation on the key cylinder 102, the lock operation unit 41 rotates. When this rotation of the lock operation unit 41 is transmitted to the open link 33, the door is locked or unlocked.

The electric actuator A3, which is provided for driving the above open link 33 to the lock position or the unlock position through the lock operation unit 41, includes an electric motor 51, a worm 52, and a locking lever 53. The electric motor 51 is a known motor driven in response to a lock operation and an unlock operation, and includes a first terminal 61, a second terminal 62, a switch 63, a connector 64, and the like for controlling an actuation thereof. The worm 52 is provided integrally with an output shaft 51*a* of the electric motor 51, and rotated and driven by the electric motor 51. The locking lever 53 is rotatably assembled to a support shaft 11*c* provided in the housing body 11.

The locking lever 53 has a sector gear 53*a* meshed with the worm 52, and also has an engagement portion (long hole) 53*b* linked with the engagement portion (pin portion) 41*a*2 of the active lever 41*a* in the lock operation unit 41. Therefore, when the electric actuator A3 is actuated, the locking lever 53 is tilted by driving force of the electric motor 51. Along with the tilting of the locking lever 53, the lock operation unit 41 is rotated. When the rotation of the lock operation unit 41 is transmitted to the open link 33, the door is locked or unlocked.

The locking lever 53 is provided with an operation portion 53*c* linked with a lock knob (not shown) provided on the indoor side of the door FD. The operation portion 53*c* is formed so as to be tilted integrally with the sector gear 53*a* and the engagement portion 53*b*. Therefore, when the lock knob (not shown) provided on the indoor side of the door FD is operated and the operation portion 53*c* is tilted, the engagement portion 53*b* of the locking lever 53 is integrally tilted, so that the lock operation unit 41 is rotated. Then, when the rotation of the lock operation unit 41 is transmitted to the open link 33, an unlock state of the door is switched to a lock state or otherwise, a lock state of the door is switched to a unlock state. It should be noted that the sector gear 53*a* is also integrally rotated so as to take the worm 52 and the electric motor 51 around.

Figure 6:
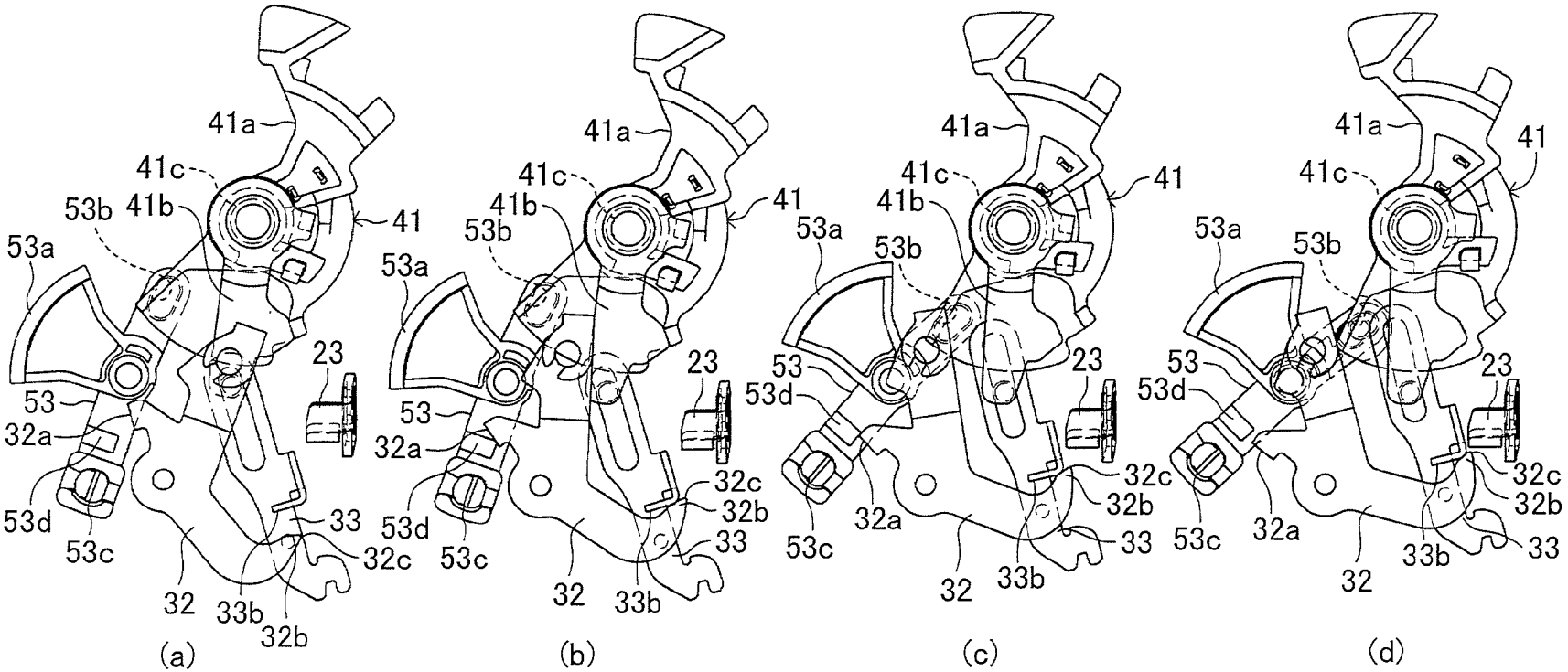
FIG. 6 is a diagram illustrating actuation when the inside open lever shown in FIG. 3 is turned counterclockwise.

Moreover, the locking lever 53 is provided with a projection 53*d* to be linked with an engagement portion 32*a* of the inside open lever 32. The projection 53*d* is configured to be pushed to turn by the engagement portion 32*a* of the inside open lever 32 when the inside open lever 32 is actuated toward the door-open direction. Accordingly, when the inside door handle (not shown) is pull-operated to actuate the inside open lever 32 toward the door-open direction, the projection 53*d* is, as shown in FIG. 6, pushed by the engagement portion 32*a* of the inside open lever 32 and then the locking lever 53 tilts clockwise in FIG. 6. Thus, also in this case, the lock operation unit 41 in the lock state rotates toward the unlock state and this rotation of the lock operation unit 41 is transmitted to the open link 33, so that the state of the door is switched from the lock state to the unlock state.

In the above door lock device Ao, as shown in FIGS. 2, 3, 5 to 8, a retaining portion 32*b* is provided on the inside open lever 32 along with a pushing portion 32*c*. The retaining portion 32*b* of the inside open lever 32 is capable of engaging with/disengaging from the pushing portion 33*b* of the open link 33 in the lock position. When the position of the open link 33 is switched through the lock operation unit 41 by the locking lever 53 from the lock position toward the unlock position (the position of the open link 33 is switched from the state FIG. 6(*a*) to (*d*)) in a state where the inside open lever 32 is actuated toward the door-open direction along with pull operation of the inside door handle (not shown) so that the open link 33 is driven while the open link 33 is in the lock position as shown in FIG. 6(*a*), the retaining portion 32*b* retains the open link 33 at a retaining position located between the lock position and the unlock position (position shown in FIG. 6(*c*) and FIG. 6(*d*)).

Figure 8:
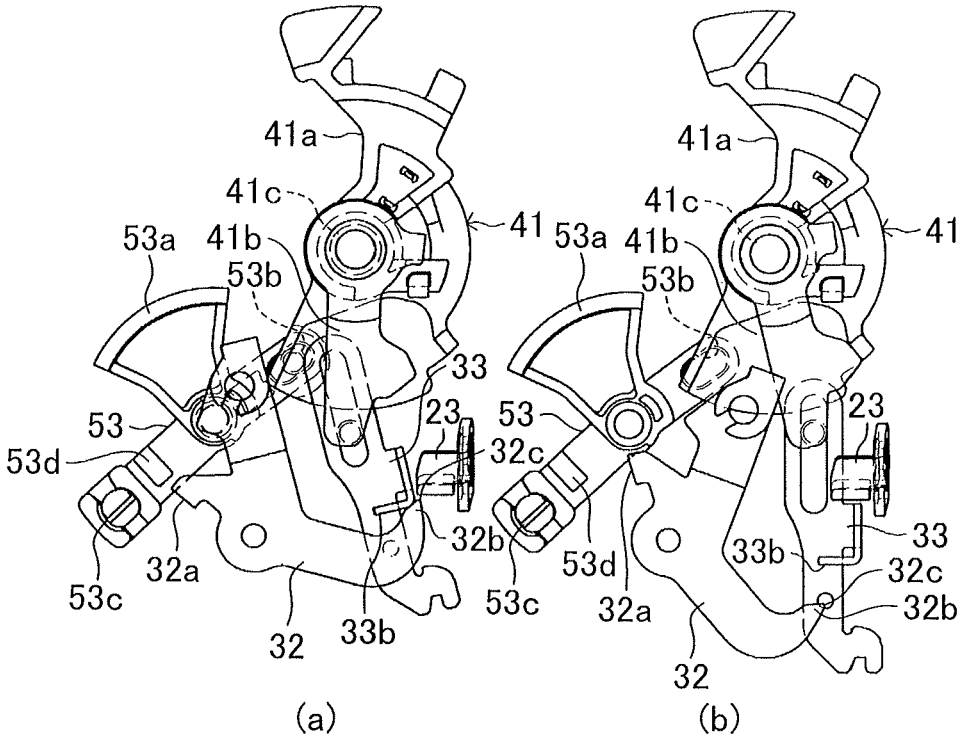
FIG. 8 is a diagram illustrating actuation when the inside open lever shown in FIG. 7 is turned clockwise.

The pushing portion 32*c* of the inside open lever 32 is capable of engaging with/disengaging from the pushing portion 33*b* of the open link 33 in the unlock position. As shown in FIGS. 2 and 8(*b*), when the inside open lever 32 is actuated toward the door-open direction along with pull operation of the inside door handle (not shown) so as to drive the open link 33 by the inside open lever 32 in a state where the open link 33 is in the unlock position, the pushing portion 33*b* of the open link 33 is pushed by the pushing portion 32*c*.

Moreover, in the above-mentioned door lock device for the vehicle Ao, a drive initiation timing to the locking lever 53 by the inside open lever 32 is set later by a predetermined amount in comparison to a drive initiation timing to the open link 33 by the inside open lever 32 (specifically, a timing for moving the open link 33 from the lock position to the unlock position is set later), so that the double-pull function is realized.

Accordingly, the open link 33 in the lock position moves to the unlock position after the open link 33 is driven by the inside open lever 32 by a predetermined amount, so that the open link 33 is retained by the retaining portion 32*b* of the inside open lever 32 at the retaining position (position shown in FIGS. 6(*c*) and (*d*)) at which the open link 33 is not engaged with (does not interfere with) the lift lever 23 in a state where the open link 33 is not capable of transmitting the door-open-direction operation to the inside open lever 32 to the lift lever 23 (so-called panic state). It should be noted that, at the position shown in FIGS. 6(*c*) and (*d*), relative rotation between the active lever 41*a* and the sub lever 41*b* is permitted because of elastic deformation of the twisted spring 41*c* (bias member) of the lock operation unit 41, so that the active lever 41*a* can be rotated to the unlock position.

As a result, in this embodiment, the above-mentioned panic state can be canceled to open the door FD by once returning the inside door handle (not shown) once experienced door-open operation and performing the door-open operation again (double-pull operation). At the time when the inside door handle (not shown) once experienced door-open operation is returned, the engagement (retainment) between the retaining portion 32*b* of the inside open lever 32 and the pushing portion 33*b* of the open link 33 is cancelled along with movement of the inside open lever 32 and the open link 33 toward their initial positions due to the return operation to the inside door handle (not shown), as shown in FIG. 8. Therefore, the sub lever 41*b* of the lock operation unit 41 is rotated to the unlock position by the twisted spring 41*c* (bias member), so that the open link 33 is moved to the unlock position as shown in FIG. 8(*b*).

Thus, in the case the door-open operation to the inside door handle (not shown) is performed again, at the time when the open link 33 is driven by the inside open lever 32, the open link 33 has been in the unlock position and the pushing portion 32*c* of the inside open lever 32 is engageable with the pushing portion 33*b* of the open link 33, so that the door-open direction operation to the inside open lever 32 is transmitted through the open link 33 to the lift lever 23. As a result, the latch mechanism 20 is switched from the latch state to unlatch state, and the door FD can be opened.

According to this embodiment, in the so-called panic state, the open link 33 is configured so as to be retained by the retaining portion 32*b* of the inside open lever 32 in the retaining position (position shown in FIGS. 6(*c*) and (*d*)) at which the open link 33 is not engaged with (does not interfere with) the lift lever 23, so that the feeling upon operation to the inside door handle (not shown) can be improved at the time of cancelling the panic state (at the time when switched from the state (a) to the state (b) in FIG. 8). As a result, it is possible to realize the above-mentioned double-pull function in the vehicle door lock device Ao and improve the feeling upon operation to the inside door handle (not shown).

Figure 7:
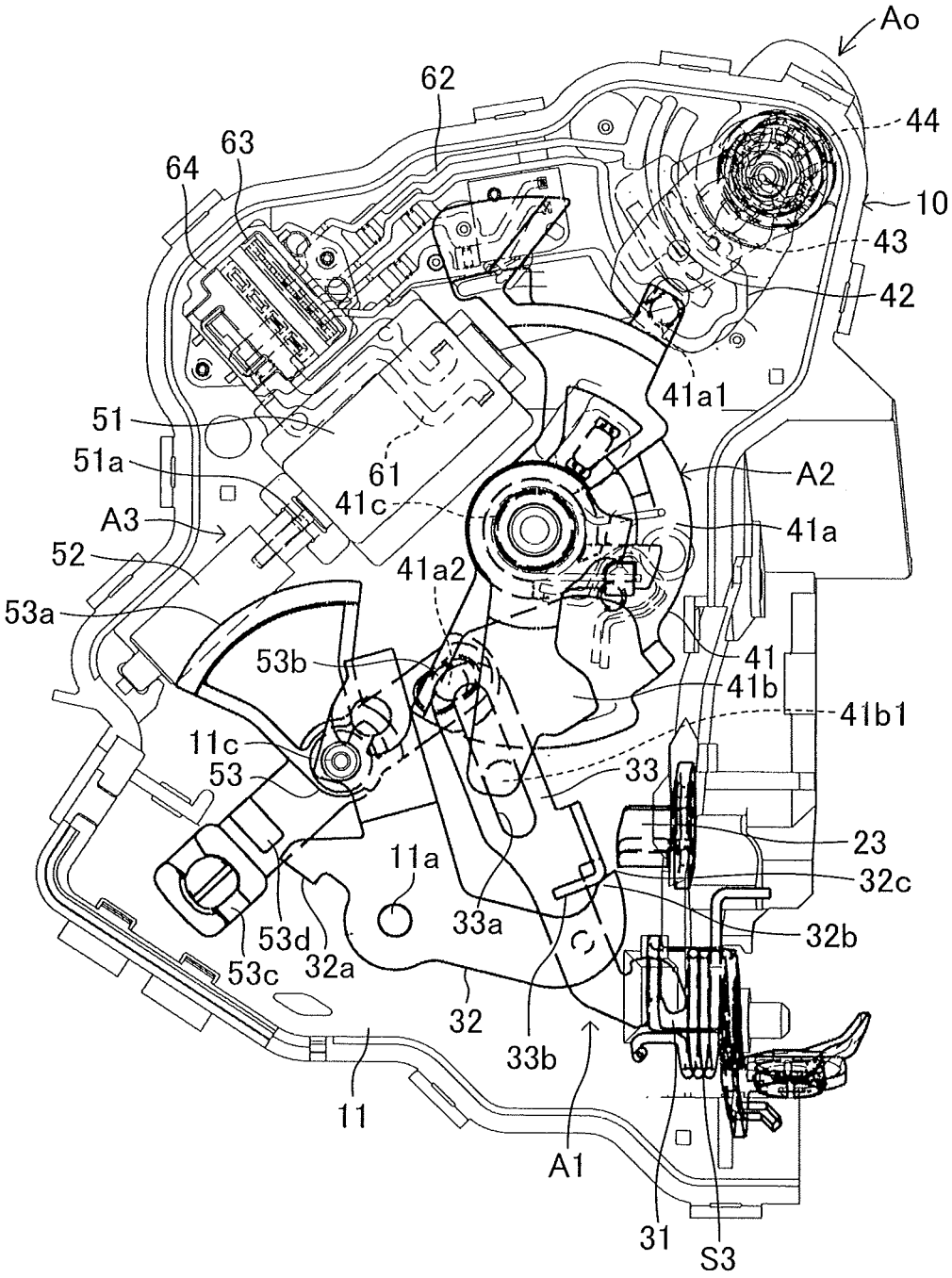
FIG. 7 is a side view of the major configuration of the door lock device for the vehicle observed from the vehicle interior when the major configuration of the door lock device for the vehicle shown in FIGS. 2 and 3 is in a state of FIG. 6(*b*) (panic state)
Figure 9:
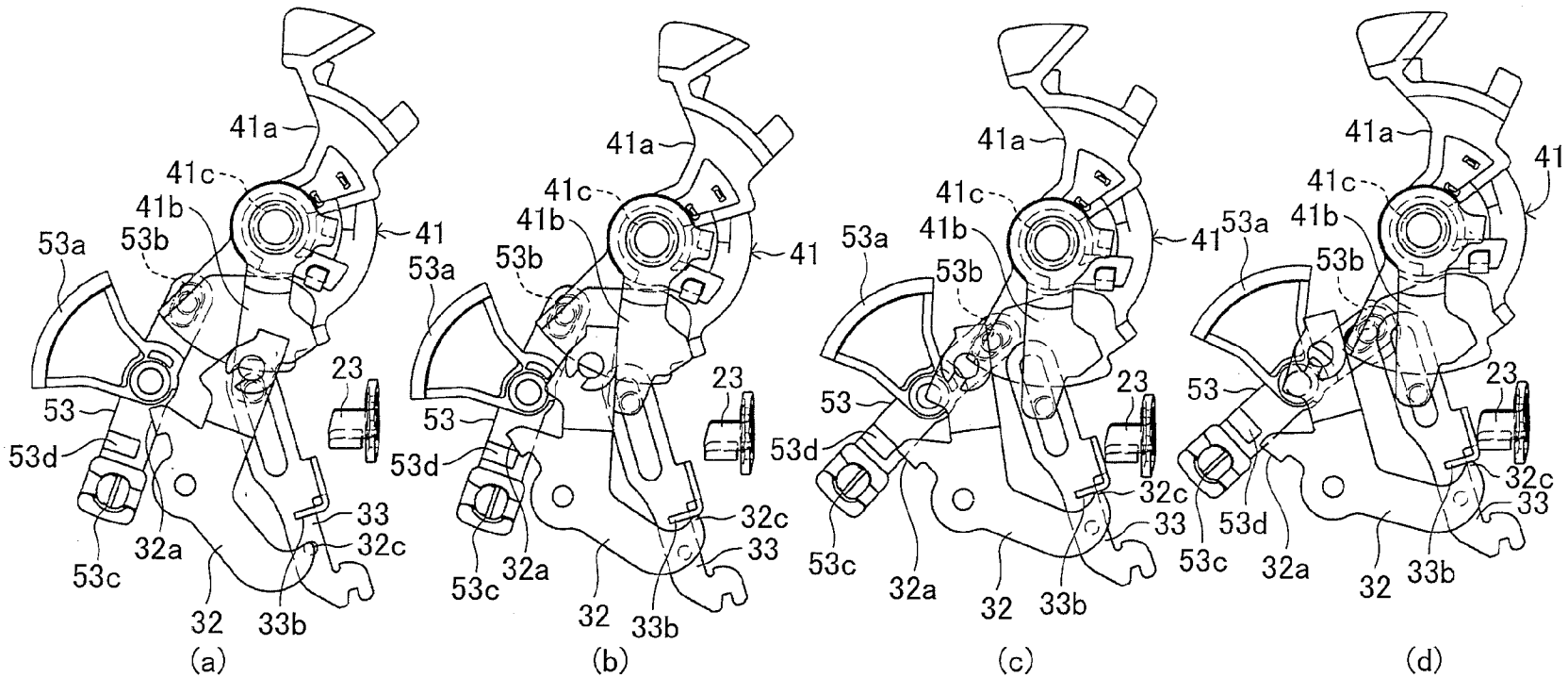
FIG. 9 is a diagram illustrating actuation corresponding to FIG. 6 in the case where the retaining portion is not provided on the inside open lever shown in FIG. 3.
Figure 10:
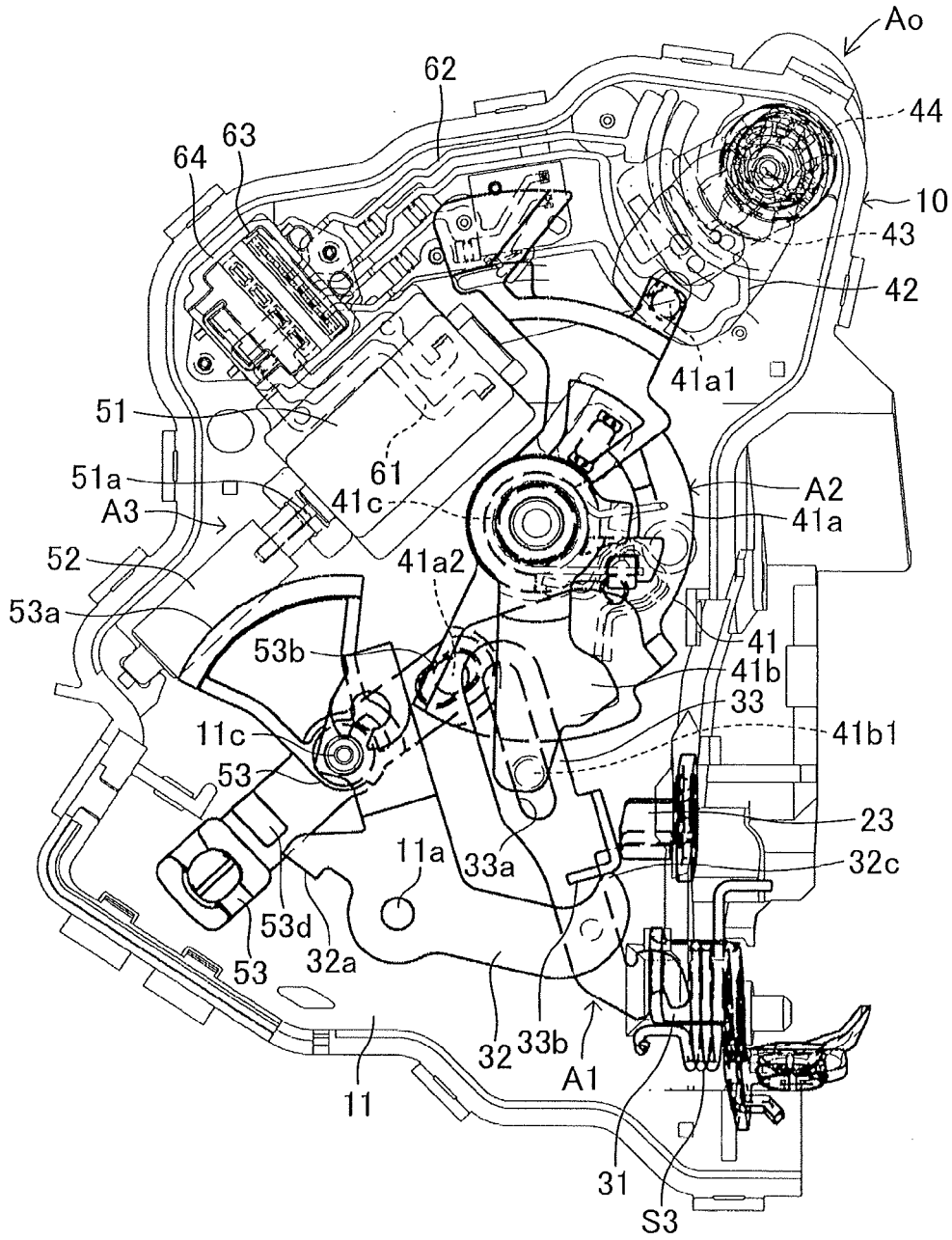
FIG. 10 is a side view of the major configuration of the door lock device for the vehicle observed from the vehicle interior when the major configuration of the vehicle door lock device is in a state of FIG. 9(*d*) (panic state)
Figure 11:
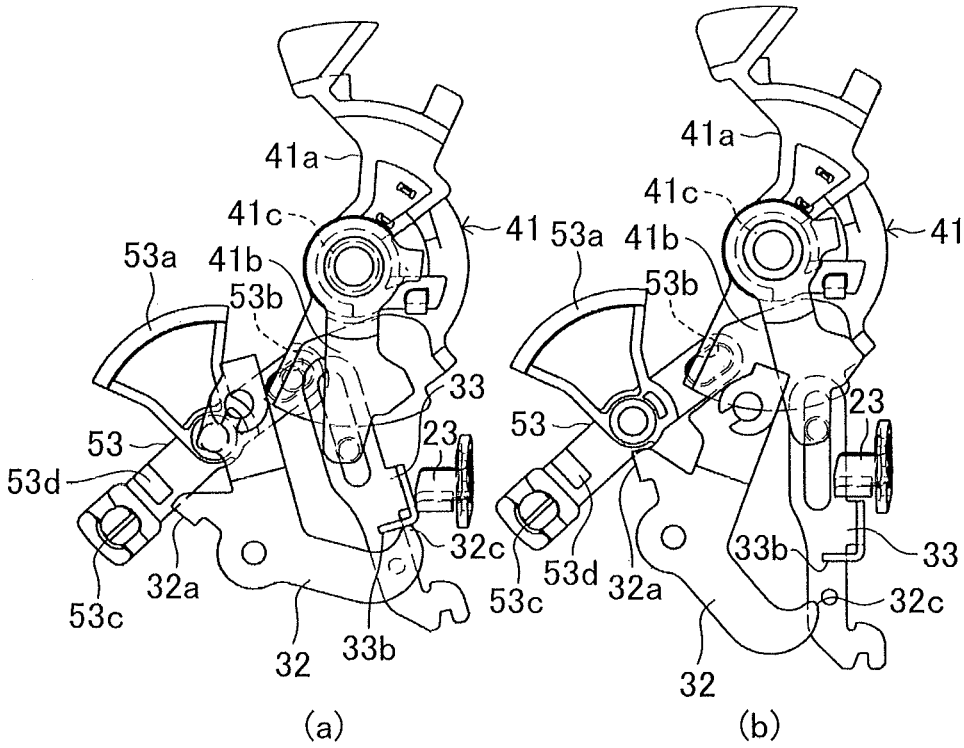
FIG. 11 is a diagram illustrating actuation when the inside open lever shown in FIG. 10 is turned clockwise.

FIGS. 9 to 11 are provided for comparison to FIGS. 6 to 8. In the vehicle door lock device Ao shown in FIGS. 9 to 11, a component corresponding to the retaining portion 32*b* of the inside open lever 32 is not provided. As a result, according to a comparison example shown in FIGS. 9 to 11, in the panic state shown in FIGS. 9(*c*) and (*d*), the pushing portion 33*b* of the open link 33 is engaged with (interfere with) the lift lever 23 and also the pushing portion 32*c* of the inside open lever 32 is engaged with (abuts against) the pushing portion 33*b* of the open link 33 in a state where the open link 33 is not capable of transmitting the door-open direction operation to the inside open lever 32. Accordingly, the feeling upon operation to the inside door handle may degrade due to this engagement between the open link 33 and the lift lever 23 in the subsequent operation (operation upon cancelling the panic state).

Although the above-mentioned embodiment is implemented in the configuration capable of both realizing the double-pull function and improving the feeling upon operation to the inside door handle when the panic state is cancelled by providing the retaining portion 32*b* to the inside open lever 32 in the door lock device for the vehicle Ao on which the double-pull function is realized, the feeling upon operation to the inside door handle when the panic state is cancelled may also be improved by providing a retaining portion which functions in a comparable manner to the above-mentioned retaining portion 32*b* to the outside open lever (31).

For implementation of the present invention, the configuration in which the open link is moved from the lock position to the unlock position directly by the inside open lever without interposing the lock operation unit, or the configuration in which the open link is moved from the lock position to the unlock position by the inside open lever through the other member in spite of the lock operation unit may be employed.

The invention claimed is:

1. A door lock device for a vehicle, comprising:

a latch mechanism adapted to be capable of retaining a vehicle door in a closed state relative to a vehicle body;

an open lever adapted to be driven along with operation to a door handle provided any of the inside and the outside of the door;

an open link interposed between the open lever and a lift lever, the open link provided in the latch mechanism, and capable of switching between an unlock position in which actuation of the open lever in a door-open direction along with door-open operation to the door handle is transmitted to the lift lever, and a lock position in which actuation of the open lever in a door-open direction along with door-open operation to the door handle is not transmitted to the lift lever; and a lock operation unit that switches the open link between the unlock position and the lock position, wherein:

the lock operation unit includes an active lever that is driven rotationally, a drive mechanism that drives the active lever, and a sub lever assembled to the active lever in a relatively rotatable manner and linked with the open link to be rotatably actuated;

the sub lever is set so as to move integrally with the active lever when the open link is switched from the unlock position to the lock position, and to move with the active lever through a bias member when the open link is switched from the lock position to the unlock position;

the open lever comprises a pushing portion and a retaining portion;

the pushing portion pushes the open link when the open lever is actuated toward the door-open direction along with door-open operation to the door handle so as to drive the open link by the open lever in a state where the open link is in the unlock position; and the retaining portion retains the open link at a retaining position between the lock position and the unlock position at which the open link is not engaged with the lift lever when the open link is switched from the lock position to the unlock position in a state where the open link is in the lock position and the open lever is actuated toward the door-open direction along with the door-open operation to the door handle to drive the open link by the open lever.

2. The door lock device for the vehicle according to claim 1, wherein the door handle is an inside door handle provided on the inside of the door, and the open lever is an inside open lever driven along with operation to the inside door handle.

3. The vehicle door lock device according to claim 1, wherein the open link does not interfere with the lift lever at the retaining position.

* * * * *

UNITED STATES PATENT AND TRADEMARK OFFICE

CERTIFICATE OF CORRECTION

PATENT NO. : 8,814,226 B2
APPLICATION NO. : 13/387468
DATED : August 26, 2014
INVENTOR(S) : Ryujiro Akizuki et al.

It is certified that error appears in the above-identified patent and that said Letters Patent is hereby corrected as shown below:

Title page, item [30]

Foreign Application Priority Data

Jul. 27, 2009 (JP)..... "2009-17448" should read "2009-174488"

Signed and Sealed this
Third Day of February, 2015

Michelle K. Lee

Michelle K. Lee
*Deputy Director of the United States Patent and Trademark Office*